United States Patent [19]

Muka

[11] 4,421,306

[45] Dec. 20, 1983

[54] DOCUMENT FEEDER WITH IMPROVED VACUUM SYSTEM

[75] Inventor: Richard S. Muka, Huntington, Conn.

[73] Assignee: Eastman Kodak Company, Rochester, N.Y.

[21] Appl. No.: 269,167

[22] Filed: Jun. 2, 1981

[51] Int. Cl.[3] ..... B65H 5/22; B65H 3/10

[52] U.S. Cl. ..... 271/5; 271/3.1; 271/245; 271/276; 271/108; 355/3 SH; 355/76

[58] Field of Search ..... 271/245, 246, 276, 3.1, 271/197, 12, 13, 11, 5, 96, 108; 355/76, 50, 51, 14 SH, 3 SH

[56] References Cited

U.S. PATENT DOCUMENTS

| | | | |
|---|---|---|---|
| 2,970,834 | 2/1961 | Martin et al. | 271/96 |
| 3,312,464 | 4/1967 | Rehm | 271/96 |
| 3,625,508 | 12/1971 | Shiragai et al. | 271/96 |
| 3,792,924 | 2/1974 | Matsuda et al. | 355/76 X |
| 3,796,424 | 3/1974 | Fox | 271/197 X |
| 4,052,128 | 10/1977 | Burton et al. | 355/76 X |
| 4,135,808 | 1/1979 | Morrison | 271/245 X |
| 4,169,674 | 10/1979 | Russel | 355/14 |
| 4,176,945 | 12/1979 | Holzhauser | 355/14 X |
| 4,179,215 | 12/1979 | Hage | 355/14 SH |
| 4,236,708 | 12/1980 | Matsuo | 271/12 |
| 4,243,316 | 1/1981 | Gustafson | 355/3 SH X |
| 4,295,737 | 10/1981 | Silverberg | 271/197 X |
| 4,362,380 | 12/1982 | Dragstedt | 355/3 SH |

FOREIGN PATENT DOCUMENTS

| | | |
|---|---|---|
| 2039860 | 8/1970 | Fed. Rep. of Germany . |
| 2905988 | 2/1979 | Fed. Rep. of Germany . |
| 1578119 | 11/1975 | United Kingdom . |

OTHER PUBLICATIONS

Research Disclosure Bulletin, Item 21139, Nov. 1981, pp. 413–415, "Document Feeder . . . " Muka.

Research Disclosure Bulletin, Item 21140, Nov. 1981, pp. 415–418, "Document Feeder . . . " Dragstedt.

Research Disclosure Bulletin, Item 21212, Dec. 1981, pp. 439–442, "Document Feeder . . . ".

Research Disclosure bulletin, Item 18540, Sep. 1979, pp. 526–527, "Simplex Document Feeder and Positioner", Gustafson et al.

Xerox Disclosure Journal, Mar./Apr. 1979, pp. 213–214, "Document Loading and Registration", Adamek et al.

*Primary Examiner*—Bruce H. Stoner, Jr.

*Attorney, Agent, or Firm*—G. Herman Childress

[57] ABSTRACT

A document feeder defines a sheet path along which a document sheet is fed across a platen of a copier/duplicator, for example, in order to copy the sheet. An oscillating vacuum tube feeds sheets from a supply into the sheet path. The feeder includes a platen vacuum transport having vacuum belts that move the sheet across the platen. The vacuum transport has a first vacuum plenum and a second vacuum plenum located along the sheet path. The first vacuum plenum has a relatively high level of vacuum to insure lifting of the sheet onto the vacuum belts. The sheet is then transported into the area where it comes under the influence of the second vacuum plenum. The second vacuum plenum has a somewhat lower level of vacuum, but it is sufficient to retain the sheet on the belts as the belts drive the sheet into engagement with a registration member. The lower level of vacuum applied at the time the sheet engages the registration member avoids damage to the leading edge of the sheet. The lower level of vacuum in the second plenum also allows the belts to be continuously driven after the sheet reaches the registration member to correct any mis-alignment of the sheet.

3 Claims, 2 Drawing Figures

DOCUMENT FEEDER WITH IMPROVED VACUUM SYSTEM

BACKGROUND OF THE INVENTION

1. Field of the Invention:

This invention relates to document feeders and, more specifically, to document feeders useful for feeding seriatim document sheets to a platen at an exposure station of a copier/duplicator. More particularly, the invention relates to such a document feeder having an improved vacuum system for a sheet transport.

2. Description of the Prior Art:

Various types of document feeders or copier/duplicators are well known in the art. For example, commonly assigned U.S. Pat. No. 4,169,674, entitled Recirculating Sheet feeder, which issued on Oct. 2, 1979 in the name of Matthew J. Russel discloses a recirculating sheet feeder wherein a stack of document sheets to be fed to a platen of a copier/duplicator is placed in a tray. An oscillating vacuum feeder removes the sheets seriatim from the bottom of the stack for transport of the sheet by various rollers to a registration position on the platen for copying. After exposure the sheet is returned to the stack on top of the other sheets remaining in the stack.

Commonly assigned U.S. Pat. No. 4,176,945, entitled Sheet Feeding Apparatus for Use With Copiers/Duplicators or the Like, which issued on Dec. 4, 1979 in the names of R. C. Holzhauser et al discloses recirculating sheet feeder wherein provision is made for inverting a document sheet and returning it to the platen for copying of a second side of the document sheet prior to returning the sheet to the top of the stack. In this manner both sides of a document sheet can be copied. The Holzhauser et al patent also dicloses document positioner apparatus whereby an individual sheet is fed to the platen, copied one or more times and removed from the platen without being fed along the entire recirculating sheet path leading from the tray to the platen and back to the tray.

It is also known to provided recirculating document feeders with vacuum sheet transports for movement of a document sheet across the platen to a registration position. In this regard, see commonly assigned U.S. Pat. No. 4,179,215, entitled RECIRCULATING DOCUMENT FEEDER, which issued on Dec. 18, 1979 in the name of C. T. Hage. A combination document feeder and positioner with a platen vacuum transport is disclosed in Item 18540 at pages 526 and 527 of the September 1979 edition of Research Disclosure, a publication of Industrial Opportunities, Ltd., Homewell, Havant, Hamshire, PO91EF, United Kingdom.

A document loading and registration apparatus is disclosed at pages 213 and 214 of the March/April, 1979 edition of the Xerox disclosure Journal. The apparatus has a vacuum belt that travels over a vacuum chamber. The chamber can be separated into two sections by a movable damper or baffle that is located at a registration point. Initially, the damper is closed to isolate one section of the chamber from a vacuum blower. A document sheet is delivered to the portion of the vacuum belt above the isolated section and registered by fingers above the belt and damper. Then the damper is moved so that both sections of the chamber communicate with the vacuum blowers, and the belt is advanced across the vacuum chamber to move the sheets to a loading station.

In some of the prior art devices described above drive rollers are used for advancing sheets across the platen and against a registration member. The drive rollers continue to be driven after the sheet reaches the registration point and thereby slip on the sheet. This allows the sheet to adjust itself into a registered position and thereby eliminate skew that may have developed in the sheet as it was moved from the stack of sheets to the registration member. Generally, this continued driving of the sheet against the registration members does not adversely affect the sheet. However, in vacuum platen transports as disclosed, for example, in the beforementioned Research Disclosure Publication, the sheet may be gripped against the vacuum belt with a relatively high vacuum force. If the belt continue to drive the sheet after the sheet reaches the registration member, there may be some damage to the leading edge of the sheet, depending upon the nature of the sheet and driving force applied to the sheet. Even so, vacuum transports are desireable because they tend to minimize or eliminate skewing of the sheet as it is transported across the platen toward the registration position. Damage to the sheet can be minimized by reducing the level of vacuum applied to the vacuum belt so that the belt can move relative to the sheet after the sheet as been stopped by the registration member. However, when this occurs the vacuum transport may encounter difficulty in initially lifting the sheet off the platen and onto the belt of the vacuum transport. Thus there is a need for a platen vacuum transport which is capable of insuring that the document sheet is lifted to the transport and, at the same time, can drive the document sheet against a registration member without damaging the sheet.

SUMMARY OF THE INVENTION

A sheet feeder in accordance with the invention is useful for feeding a sheet along a path leading to a work station. First vacuum operated means is effective to at least partially remove a sheet from a first position and feed the sheet into the path. Second vacuum operated means receives a sheet from the first means and advances the sheet along the path to the work station. The second means comprises a vacuum transport having means for applying a first level of vacuum to a sheet as the sheet travels along part of the path and for applying a second and different level of vacuum to the sheet as the sheet travels along another part of the path.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
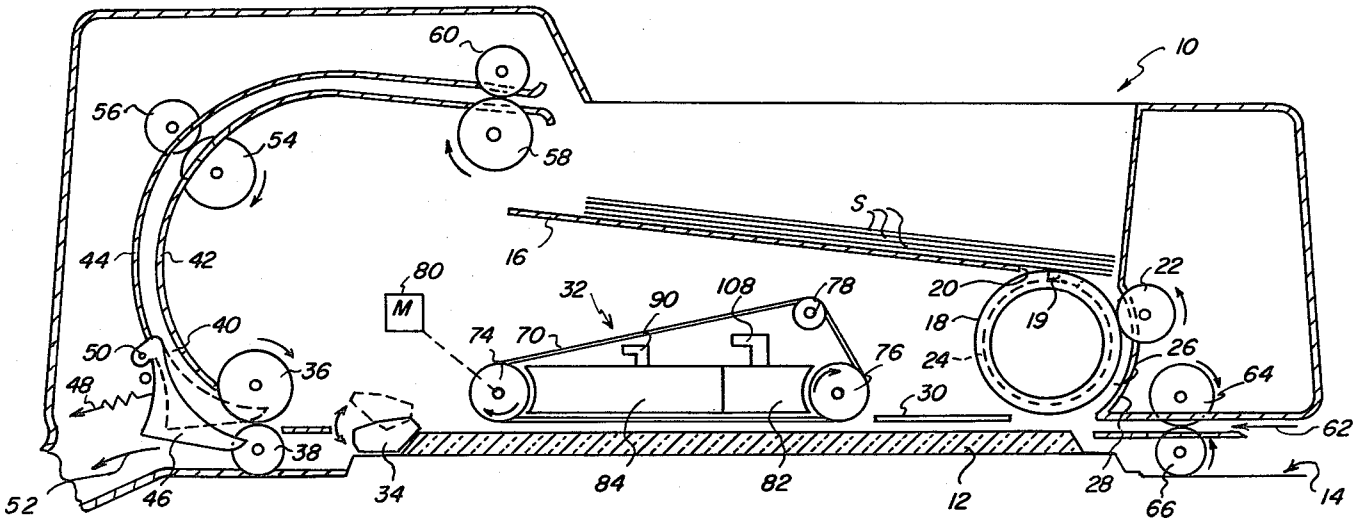
FIG. 1 is a generally schematic view illustrating a document feeder of the present invention.

Referring now to FIG. 1, a document feeder of the present invention is generally designated 10 and is shown mounted in an operative position over the platen 12 of a copier/duplicator or the like, a portion of which is shown at 14. In some respects the document feeder 10 and copier 14 are the same as, or similar to, the disclosures in the beforementioned Research Disclosure Publication and in the commonly assigned U.S. Patents.

Accordingly, the disclosures of such publication and patents are incorporated herein by reference.

Figure 2:
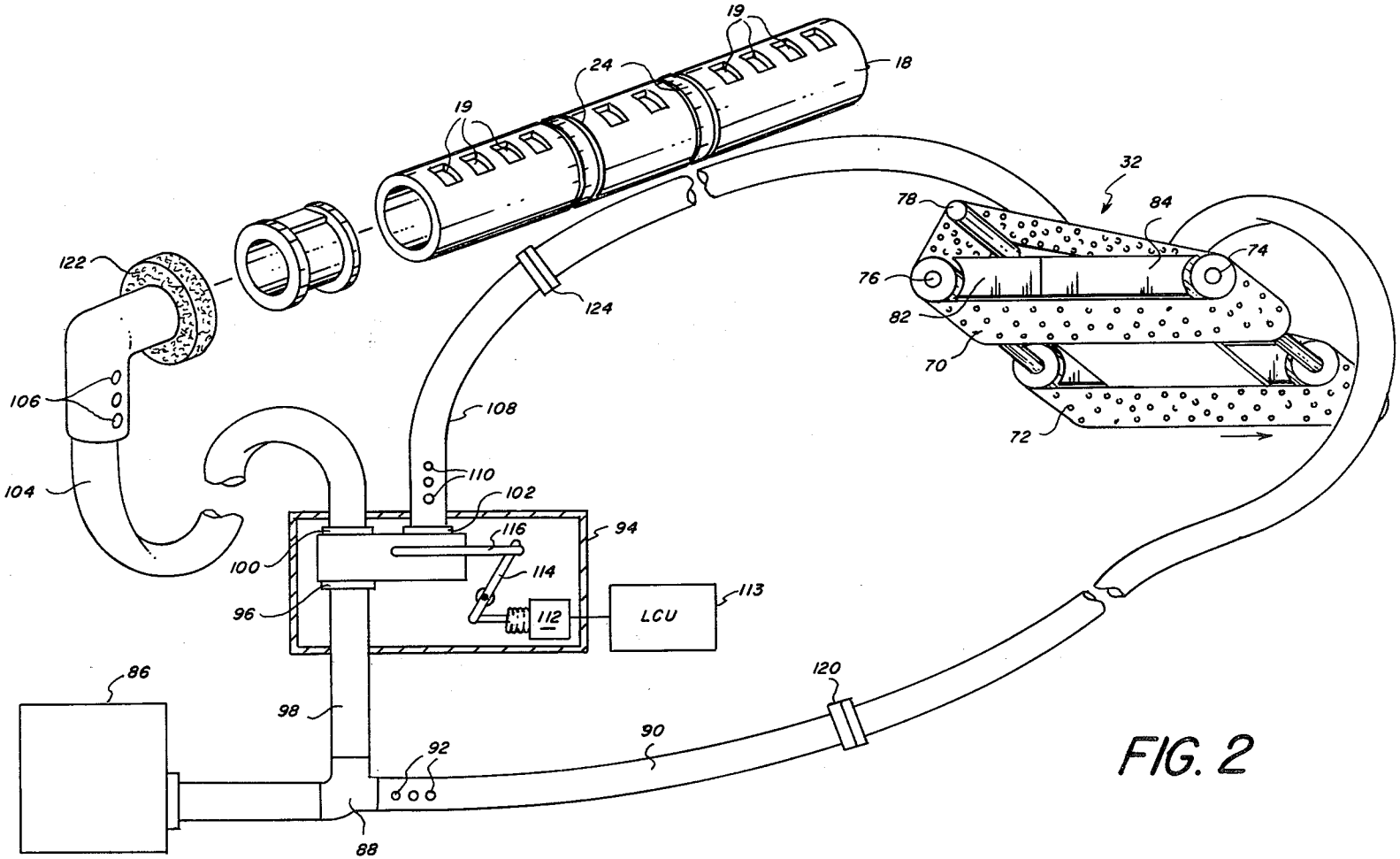
FIG. 2 is a schematic view of the vacuum system for the document feeder illustrated in FIG. 1.

The feeder 10 has a tray 16 spaced above the platen 12. The feeder is open at the top so that a set of document sheets S arranged in stack can be placed on the tray 16 for removal seriatim beginning with the lowermost sheet in the stack. Removal of the sheets from the stack is effected by a sheet feeder 18 comprising an oscillating vacuum tube. The feeder tube has a series of ports 19 arranged in a row as shown in FIG. 2. The ports are located beneath an opening 20 in the tray so that when vacuum in applied to the feeder 18 the lowermost sheet in tray 16 is attracted to the tube. Then the tube is rotated in a clockwise direction as viewed in FIG. 1 to bring the leading edge of the sheet into a nip between drive rollers 22 and rings 24. The rings are rotatably mounted on the tube 18 and recessed into the tube so that the outer surface of the rings and tube are substantially aligned. After the sheet is fed into the nip between the rollers 22 and rings 24, the tube oscillates in a counter clockwise direction back to its original position. The vacuum supply to the feeder is shut off during return movement as explained in more detail later.

The removed sheet is then fed through a guide slot 26 onto the platen 12. The guide slot 26 is defined by the surface of the tube 18, by an arcuate guide 28 adjacent to the tube, and by a flat plate 30 which is located above the platen and limits upward movement of the sheet away from the platen. The recirculating feeder structure described hereinbefore in more detail in the beforementioned U.S. Pat. No. 4,169,674, As a sheet S is advanced across the platen 12 from right to left as viewed in FIG. 1, it reaches a platen vacuum transport generally designated 32 which will be described in more detail later. Transport 32 is effective to advance the sheet across the platen and into engagement with a registration gate member 34. Registration member 34 can be of any suitable construction and may, for example, be constructed as disclosed in commonly assigned U.S. Pat. No. 4,243,316, entitled Registration Mechanism, which issued Jan. 6, 1981 in the name of G. B. Gustafson. Preferably, transport 32 continues to urge the sheet against the registration member 34 even after initial contact therebetween so that any skew or misalignment that may exist in the sheet will be removed by allowing the driven sheet to adjust its relative position on the platen unitl all parts of the leading edge of the sheet are aligned with the gate member 34. When the sheet is properly aligned it is exposed by flash lamps (not shown) located beneath the platen 12 or by a scanning mechanism. An image of the document sheet is formed on a photoconductor and a copy of the document is produced in a conventional manner.

After exposure of the document sheet, gate member 34 is lifted to its dotted line position above the sheet path. Transport 32 then drives the sheet off the platen and into the nip between a pair of rollers 36 and 38. Ordinarily these rollers drive the sheet into a guide path 40 defined by a pair of stationary guide members 42 and 44 and a movable guide member 46. Normally the movable guide member 46 is urged into the position illustrated by a spring shown diagramatically at 48. When a sheet is to be removed from the feeder 10 after exposure (i.e., not recirculated), the movable guide member 46 is swung about a pivot 50 away from its solid line position into its dotted line position. This movement can be accomplished by any suitable moving means, such as a solenoid (not shown). When guide member 46 is in its dotted line position the sheet is deflected out of the feeder along a path shown by arrow 52.

The sheet is driven along guide path 40 by rollers 36, 38 and by two additional pair of rollers 54, 56 and 58, 60 located along the path. the sheet leaves the upper end of guide path 40 above the tray 16 and above the sheets S resting in the tray. Thus the sheet is returned to the stack of sheets on top of other sheets remaining in the stack. The result of one complete circulation of a sheet as described is that a sheet is inverted once after it is removed from the stack and before presentation for copying on the platen 12, and then inverted a second time after removal from the platen and before being returned to the tray 16. As to the set of document sheets, a sheet occupies the same position, relative to other sheets, before and after seriatim circulation of the entire set of document sheets.

The feeder has a document positioner mode of operation wherein a document sheet is fed to the platen along a non-recirculating path for copying one or more times. In this mode the sheet is fed to the feeder along a path shown at 62 in FIG. 1. The sheet is driven onto the platen 12 and into path 26 by a pair of nip rollers 64, 66. When the sheet reaches the platen vacuum transport 32, it is advanced against the registration member 34 and copied as explained hereinbefore. Then when the registration member is raised the movable guide member 46 is swung to its dotted line position and the transport 32 drives the sheet off the platen and into the nip between rollers 36, 38. Then the sheet is driven along path 52 and removed from the feeder. This document positioner mode of operation is disclosed in more detail in the beforementioned Research Disclosure Publication and in U.S. Pat. No. 4,176.945.

Referring now to FIGS. 1 and 2, the platen vacuum transport 32 preferably comprises a pair of endless vacuum belts 70 and 72 which are trained about three rollers 74, 76 and 78. Roller 74 is coupled to a motor 80 as shown schematically in FIG. 1 so that the roller 74 is driven in a clockwise direction as viewed in FIG. 1. Movement of roller 74 is effective to rotate the belts 70 and 72 about the various rollers, thereby moving the lower most reach of the belts in a right-to-left direction as viewed in FIG. 1 for advancing a sheet toward the registration member 34. Preferably the belts 70 and 72 are of a white material and have a multiplicity of small holes therethrough through which air can be drawn for attracting a sheet to the belt. The belts are shown in FIG. 2 as being spaced from each other but they can be closely adjacent to each other or a single belt can be used if desired.

Located inside the endless belts are a first vacuum plenum 82 and a second vacuum plenum 84. The first plenum is located along the sheet path between plenum 84 and oscillating vacuum feeder 18 so that a sheet being moved along the portion of the path 26 leading from the tray to the registration member first comes under the influence of vacuum in the plenum 82 and then under the influence of vacuum from plenum 84. The plenums are closely adjacent the lower reach of the belts 70 and 72 and the plenums having openings on the lower side thereof. When air is evacuated from the plenums a partial vacuum is created in the plenums, and this partial vacuum is transferred through the openings in the bottom of the plenums and through the openings in the belts to attract a sheet to the belts.

Vacuum is provided by a single vacuum blower 86 (FIG. 2). The inlet to the blower is connected to a T-shaped coupling 88. One branch of the coupling is coupled by a conduit 90 directly to the second vacuum plenum 84. In this manner anytime the blower is operated there is a partial vacuum established in plenum 84. Preferably a series of vents 92 are provided in conduit 90 so that when the blower is shut off the conduit 90 and plenum 84 will promptly return to atmospheric pressure. These vents also serve to limit the level of vacuum applied to the plenum 84.

The application of vacuum to the oscillating vacuum feeder 18 and to the first plenum 82 is regulated by a control valve 94. Valve 94 has an inlet port 96 that is connected to another branch of the coupling 88 by a conduit 98. Valve 94 has two outlet ports 100 and 102. Outlet port 100 is coupled by a conduit 104 to the oscillating vacuum feeder 18. A plurality of vents 106 allow the vacuum tube to return to atmospheric pressure when the blower 86 is stopped or the valve 94 shuts off communication between the blower and the vacuum feeder. These vents also serve to limit of the vacuum in the oscillating vacuum feeder. Similarly, a conduit 108 is coupled to the outlet port 102 of valve 94 and to the first vacuum plenum 82. This conduit also has vents 110 therein for allowing the plenum 82 to return to atmospheric pressure and for limiting the level of vacuum applied to the plenum.

Control valve 94 preferably is operated by a solenoid 112 which is energized and deenergized by the control mechanism for the feeder. The control mechanism may comprise for example, a logic and control unit (LCU) 113. The valve has a lever 114 pivoted intermediate its ends. Solenoid 112 has an armature connected to one end portion of the lever 114, and the other end portion of the lever is connected to a slider 116.

When the solenoid is deenergized the lever and slider occupy the positions illustrated in FIG. 2. at this time the left end of the slider 116 blocks the passage of air through conduit 108 into the control valve by closing off the outlet port 102 of the valve. However, port 100 is open so blower 96 is effective to provide a partial vacuum in the oscillating vacuum feeder 18 through the control valve 94 and conduit 104. The blower also provides a partial vacuum in plenum 84 through conduit 90.

When the solenoid 112 is energized lever 114 moves in a counterclockwise direction to move the slider 116 to the left. The effect of this movement is that the slider 116 now blocks the outlet port 100, thereby interrupting the supply of vacuum to the vacuum feeder 118 and the feeder returns to atmospheric pressure by air flowing through the vents 106. At the same time, the slider 116 opens the outlet port 102 of the valve 94 to allow air to be drawn through conduit 108 from the vacuum plenum 82, thereby establishing a partial vacuum in the plenum 82. Blower 86 continues to apply vacuum in plenum 84. When the solenoid 112 is deenergized lever 114 returns to its original position, as shown in the drawings, port 100 is uncovered and port 102 is again blocked. Plenum 82 can then return to atmospheric pressure by air entering the vents 110. Vacuum again is provided to the oscillating vacuum feeder. Conduits 90, 104 and 108 can be provided with breakable couplings 120, 122 and 124, respectively along the interface between the copier 14 and feeder 10. These couplings facilitate assembly and repair of the feeder.

Conduits 90, 104 and 108 can be provided with breakable couplings 120, 122 and 124, respectively along the interface between the copier 14 and feeder 10. These couplings facilitate assembly and repair of the feeder.

Preferably, plenum 82 is smaller than plenum 84. Also, a higher level of vacuum is established in plenum 82 than in plenum 84. A principal function of plenum 82 is to lift the sheet from the platen onto the lower reach of belts 70 and 72. This function is more likely to be successfully accomplished by a relatively high level of vacuum. On the other hand, a principal function of plenum 84 is to hold the sheet against the belts while the sheet is driven into registered engagement with registration member 34 without damaging the leading edge of the sheet when it is driven against member 34. Once a sheet is tacked to the belts by plenum 82, a lower level of vacuum is needed to hold the sheet to the belts. Because the belts 70, 72 preferably continue to move after the leading edge of the sheet strikes member 34, the lower level of vacuum in plenum 84 allows slippage between the belts and the sheets without damaging the leading edge of the sheet.

LCU 113 is shown connected to solenoid 112. As is known in the art, the LCU can receive signals from various sensors in feeder 10 and copier 14 and furnish control signals to not only the solenoid 112 but also to blower 86, motor 80 and other parts of the feeder and copier to provide a controller sequence of operations.

Operation of the apparatus will now be described. Assume initially that control valve 94 is in the position shown in FIG. 2, i.e., port 100 is open and port 102 is closed so that the vacuum blower 86 can provide a vacuum in the oscillating vacuum feeder and in vacuum plenum 84, but not to vacuum plenum 82. Vacuum applied to the vacuum feeder 18 causes the lowermost sheet S in the tray 16 to be attracted to the ports 19 of the vacuum feeder. Then in response to a signal from the logic and control unit of the apparatus, the oscillating vacuum feeder rotates clockwise to partially withdraw the lowermost sheet S from the tray and to feed the leading edge of the sheet into the nip between the drive rollers 22 and the rings 24. Immediately after the document is fed into this nip solenoid 112 of the control valve 94 is energized to move the slider 116 to its second position wherein port 100 is blocked, thereby allowing the oscillating vacuum feeder to return to atmospheric pressure. This releases the sheet from the oscillating vacuum feeder and allows it to be transported along the first portion of the feeder path by the rollers 22 and rings 24.

When solenoid 112 is energized valve 94 connects the vacuum blower 86 to the first vacuum plenum 82 to establish a partial vacuum in that plenum. Thus when the leading edge of the sheet is furnished into the space beneath the lower reach of belts 70 and 72 and beneath the vacuum plenum 82, the relatively high level of vacuum in the plenum 82 causes the sheet to be lifted up onto the belts and tacked to the belts. At this time, the belts are being driven in a direction to advance the sheet along the platen towards the registration member 34. Thus the sheet travels beneath the first vacuum plenum 82 and ultimately is delivered into the area beneath the second vacuum plenum 84. As noted previously, air is continuously evacuated from plenum 84 through conduit 90 and the blower 86, the level of vacuum in plenum 84 being somewhat lower than the level of vacuum in plenum 82.

For a period of time the sheet is held against the belts 70 and 72 by vacuum from both plenums 82 and 84. However, before the leading edge of the sheet reaches the registration member 34, solenoid 112 is valve 94 is deenergized to allow the slider 116 to return to the position illustrated in FIG. 2. This opens the valve to port 100 and closes and valve to port 102, thereby interrupting the flow of air from plenum 82 through the valve to the vacuum blower 86. The vacuum is plenum 82 is vented through holes 110 so that the plenum promptly returns to substantially atmospheric pressure. At this time the sheet is transported under the influence of vacuum from plenum 84 only. The lower level of vacuum in plenum 84 is sufficient to retain the sheet against the belts for movement across the platen and into engagement with the registration member 34. As a result, the sheet leading edge strikes the registration member 34 with a relatively low force. The sheet can be stopped by the registration member even though the belts continue to move toward the registration member, thereby allowing any misalignment of the sheet to be corrected by continued movement of the belts. The relatively low force applied by the belts prevents any damage to the sheets.

After the sheet is properly aligned on the platen it is illuminated to provide an image to the copier. Then the registration member is moved out of the path of the sheet and the sheet is advanced past the registration position and into the nip formed by rollers 36 and 38 under control of vacuum in plenum 84 and the movement of the belts 70 and 72.

When the first sheet enters the nip between rollers 36 and 38, it is normally advanced through sheet path 40 and returned to try 16 on top of any sheets remaining in the tray as previously explained. Alternatively, the movable guide member 46 can be swung to its dotted line position to allow removal of the sheet along the path designated 52. As noted earlier, when the valve 94 returns to the position illustrated in FIG. 2, vacuum is again applied to the oscillating vacuum feeder 18. The vacuum thus applied attracts the leading edge of the second sheet in the stack to the oscillating vacuum feeder. Once the registration member is raised the oscillating vacuum feeder can be oscillated clockwise again to initiate feeding movement of the second sheet.

After the trailing edge of the first sheet passes the registration member, the registration member is returned to the position shown is solid lines in FIG. 1 so that it can be engaged by the second document sheet to register that sheet. The cycle is repeated as required until the document sheets have all been circulated one or more times for copying.

The level of vacuum in plenums 82 and 84 can be varied as required, depending upon the type and weight of document sheets to be handled. By way of example, 8½ by 11" sheets of 13, 20, and 32 pound weight can be transported with an initial vacuum level equal to about 1 inch (2.5 cm.) of water in plenum 82 with an air flow rate of about 13 cubic feet per minute (0.4 cubic meters per minute). This changes to about 8 inches (20 cm.) of water with an air flow of 1 CFM (0.03 cubic meters per minute) when the document sheet fully covers the bottom of the vacuum plenum. Similarly, the level of vacuum in plenum 84 can initially be about ½" (1.3 cm.) of water with an air flow rate of 3 CFM (0.09 cubic meters per minute). This changes to about 3 inches (7.6 cm.) of water and an air flow rate of 0.5 CFM (0.01 cubic meters per minute) when the document sheet fully covers the bottom of the plenum. A vacuum level of about 17 inches (43 cm.) has been found sufficient for the oscillating vacuum feeder. The inside diameters of conduits 90, 104 and 108, respectively can be about 0.625 in (1.6 cm.), 1.75 in (4.5 cm.) and one inch (2.5 cm.).

As noted earlier, plenum 82 preferably is smaller than plenum 84. The apertures in the bottom of each plenum can comprise about 1.5 square inches (9.7 sq. cm.). The belts can be about 1.5 inches (3.8 cm.) wide with 0.2 in (0.5 cm.) diameter holes therethrough arranged on 0.5 in (1.3 cm.) center lines in three staggered rows.

The ability of the first plenum 82 to pick up a sheet being moved across the platen can be improved by increasing the port area of the plenum to allow a greater air flow and thereby produce more lift.

One of the advantages of the present invention is that the platen vacuum transport provides a high gripping and lift force in the area of the first vacuum plenum 82. This assures lifting of the sheet onto the belts and also prevents skew of the document sheet. At the same time, when the document sheet leading edge reaches the registration gate, it is being advanced only by the relatively lower vacuum pressure applied through plenum 84 so that lower gate registration forces are encountered, thereby minimizing damage to the leading edge of the sheet due to contact with the registration member. In addition, only a single blower is required for the oscillating vacuum feeder and both sections of the platen vacuum transport.

The invention has been described in detail with particular reference to a preferred embodiment thereof, but it will be understood that variations and modifications can be effected within the spirit and scope of the invention as described hereinabove and defined in the appended claims.

I claim:

1. In a vacuum system for a document feeder, the feeder being useful for feeding seriatim a plurality of document sheets along a path having (1) a first portion extending from a stack of such sheets to an exposure position, wherein the sheets are registered and copied, and (2) a second portion leading away from the exposure position, the feeder having an oscillating vacuum member for removing a sheet from the stack and initiating movement of the removed sheet along the first portion of the path and at least one vacuum belt for receiving a sheet removed by the vacuum member and for advancing the sheet along the first portion of the path toward the exposure position, the improvement comprising:

a first vacuum plenum and a second vacuum plenum positioned adjacent said belt along the first portion of the sheet path so that a sheet can be attracted to the belt for transport along the first portion of the path when a partial vacuum exists in at least one of said plenums, the first plenum being located along said path between the second plenum and the vacuum member;

a vacuum blower;

a control valve having an inlet port coupled to said blower, said valve having a first outlet port coupled to the vacuum member and a second outlet port coupled to said first plenum, said valve being adjustable between (1) a first position wherein the vacuum member is connected to the blower to establish a partial vacuum in the vacuum member and (2) a second position wherein the first plenum is connected to the blower to establish a partial vacuum in the first plenum;

a conduit interconnecting said blower and said second plenum so that operation of the blower is effective to establish a partial vacuum in said second plenum; and control means for operating said valve in a programmed sequence wherein (1) the valve is in its first position to establish a partial vacuum in the oscillating vacuum member for feeding a sheet from a stack and into the first portion of the path and (2) the valve then is adjusted to its second position to establish a partial vacuum in the first plenum to hold the sheet against the belt while the belt moves the sheet along the first portion of the path until the sheet falls under the influence of vacuum in the second plenum.

2. The invention as set forth in claim 1 wherein the belt and the plenums are located above the first portion of the path and a reach of the belt is between the path and the plenums, means for establishing a level of vacuum in the first plenum that is greater than the level of vacuum in the second plenum, and the level of vacuum in the first plenum being such that a sheet in the path beneath the first plenum can be picked up and held against the belt by the vacuum in the first plenum.

3. The invention as set forth in claim 2 further comprising a registration member movable between a first position spaced from the path and a second position extending across the path, the registration member when in its second position being engageable by a sheet being transported by the belt to stop the sheet at the exposure position, and the level of vacuum in the second plenum being sufficiently low so that the belt can slip relative to a sheet stopped by the registration member.

* * * * *